US007136500B2

(12) United States Patent
Collins

(10) Patent No.: US 7,136,500 B2
(45) Date of Patent: Nov. 14, 2006

(54) ELECTRET CONDENSER MICROPHONE

(75) Inventor: James S. Collins, Elk Grove Village, IL (US)

(73) Assignee: Knowles Electronics, LLC., Itasca, IL (US)

( * ) Notice: Subject to any disclaimer, the term of this patent is extended or adjusted under 35 U.S.C. 154(b) by 489 days.

(21) Appl. No.: 10/634,552

(22) Filed: Aug. 5, 2003

(65) Prior Publication Data

US 2005/0031150 A1 Feb. 10, 2005

(51) Int. Cl.
*H04R 25/00* (2006.01)

(52) U.S. Cl. ..... 381/369; 381/359; 381/191

(58) Field of Classification Search ..... 381/113, 381/355, 359–361, 369, 174, 176, 178, 392, 381/191

See application file for complete search history.

(56) References Cited

U.S. PATENT DOCUMENTS 2,852,620 A 9/1958 Schoeps et al.
4,281,222 A 7/1981 Nakagawa et al.
4,456,796 A 6/1984 Nakagawa et al.
5,442,713 A * 8/1995 Patel et al. ..... 381/357
6,904,155 B1 * 6/2005 Yonehara et al. ..... 381/191
2005/0089180 A1 * 4/2005 Saeki et al. ..... 381/369

FOREIGN PATENT DOCUMENTS

EP 1 298 958 A2 4/2003
JP 2000-232700 A2 2/1999

OTHER PUBLICATIONS

Gorelik et al., "Neues Studiokondensatormikrofon PM 860", vol. 33, No. 2, Mar. 1, 1989, pp. 26-32.

* cited by examiner

*Primary Examiner*—Suhan Ni
(74) *Attorney, Agent, or Firm*—Marshall, Gerstein & Borun LLP

(57) ABSTRACT

An electret condenser microphone includes a housing, a diaphragm disposed within the housing, first and second sound inlet ports and an acoustic resistive material disposed within the housing and in the acoustic path between the second inlet port and the diaphragm. The acoustic resistive may further electrically couple a backplate coupled to the diaphragm to an amplifier disposed within the housing.

3 Claims, 3 Drawing Sheets

ELECTRET CONDENSER MICROPHONE

TECHNICAL FIELD

This patent relates to microphones, and more particularly, to electret condenser microphones incorporating an acoustic resistive element.

BACKGROUND

Unidirectional electret condenser microphones (ECM"s) typically include a housing, a diaphragm and a ring assembly, a backplate, and a spacer separating the diaphragm and ring assembly from the backplate. The ECM may also include an amplifier that may be disposed on a printed circuit board electrically coupled to the backplate. These components are mounted within the housing. One way in which ECMs operate is by allowing acoustic vibrations to enter the housing and allowing the diaphragm to vibrate in response thereto. The vibrating diaphragm causes a capacitance change between the diaphragm and the backplate that may be detected as an electrical signal. The electrical signal is coupled to the amplifier by a suitable conductor, such as wire, to produce an output from the ECM.

Typically, the unidirectional ECM should provide a high performance and control so that the sound coming from the front of the microphone is reinforced and the sound coming from the back is canceled. A unidirectional ECM may be made directional in order to enhance the performance with respect to sound coming from the front of the microphone by adding a second sound inlet port, such that there is one at the front and one at the back of the ECM. The sound entering from the front of the microphone goes directly to the diaphragm. The sound entering from the back of the microphone is delayed by a resistive/capacitive (RC) acoustic network. This delay is made so that the sound coming from the front of the microphone is reinforced and the sound from the back is cancelled.

To implement the RC acoustic network, an acoustic resistive material may be disposed between the second sound inlet port and the diaphragm. This material may be made of sintered plastics, plastic felts, laser drilled disks, and the sound is made to travel through the material perpendicular to a plane of the material. That is, the material is typically provided in the form of a sheet or layer having a first surface and a second surface. The sound is then made to travel substantially perpendicular to the first and second surfaces.

This arrangement of the acoustic resistive material has several disadvantages. The acoustic resistive materials often have a relatively large amount of variability that has a great effect on the directional performance of the microphone, with laser drilled disks providing the least amount of variability of the currently available materials but at higher cost. Also, the physical volume of the material places limits on the size of the ECM making size reductions difficult.

Accordingly, there is a need for an ECM that is inexpensive, simple to manufacture and scalable to relatively small sizes.

DETAILED DESCRIPTION

Figure 1:
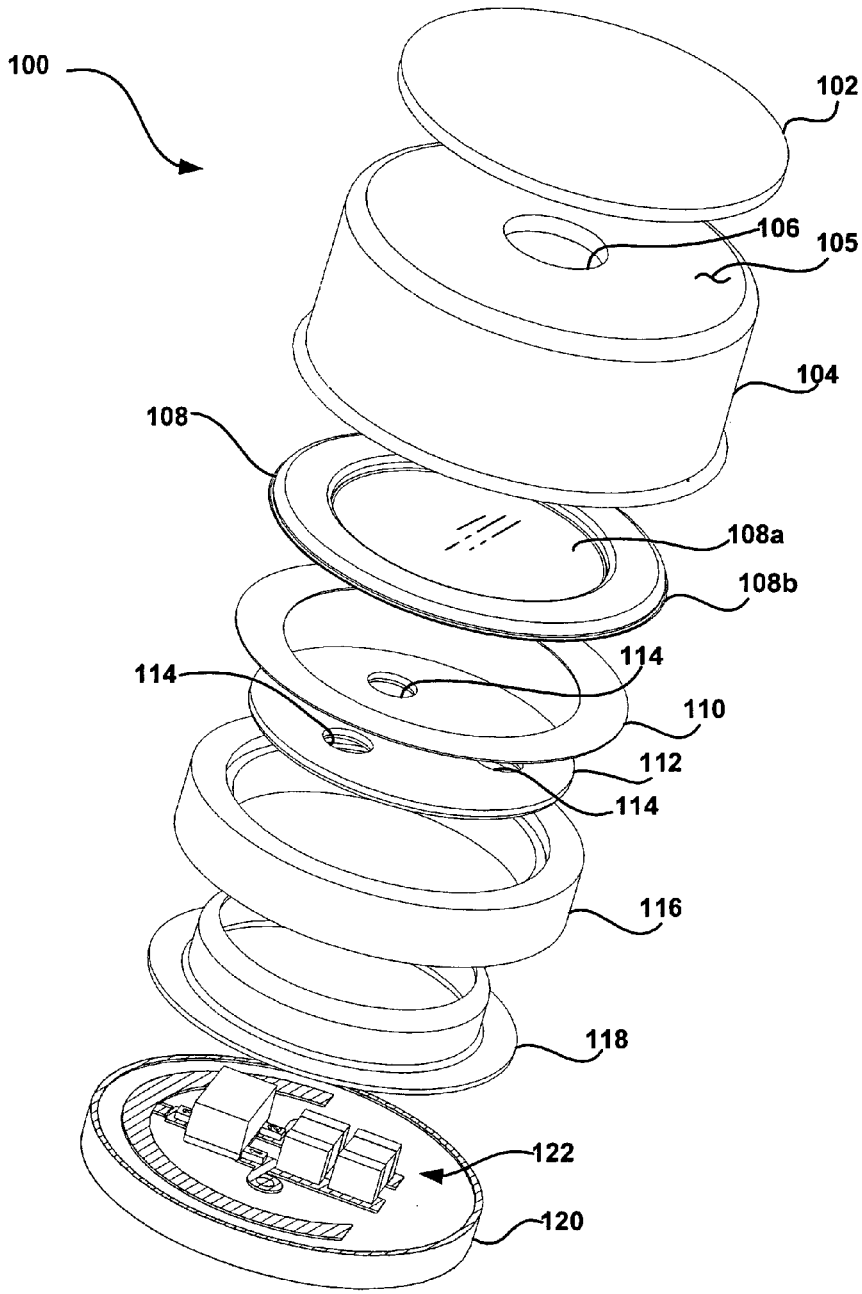
FIG. 1 is en exploded view illustrating an embodiment of an electret condenser microphone (ECM)

While the present invention is susceptible to various modifications and alternative forms, certain embodiments are shown by way of example in the drawings and these embodiments will be described in detail herein. It should be understood, however, that this disclosure is not intended to limit the invention to the particular forms described, but to the contrary, the invention is intended to cover all modifications, alternatives, and equivalents falling within the spirit and scope of the invention defined by the appended claims.

As will be appreciated from the following description of embodiments, an ECM may include a housing for the microphone. The housing may have a first sound inlet port and a second sound inlet port separate from and spaced apart from the first sound inlet port. A diaphragm may be disposed within the housing with the diaphragm having a first side and a second side. The first side of the diaphragm may be acoustically coupled to the first sound inlet port and the second side of the diaphragm may be acoustically coupled to the second sound inlet port. An acoustic resistive element may be disposed within the housing and between the second sound inlet port and the second side of the diaphragm. The acoustic resistive element may have a first surface and a second surface separate and spaced apart from the first surface and a first edge extending between the first surface and the second surface and a second edge extending between the first surface and the second surface. The first edge may be acoustically communicatively coupled to the second inlet port and the second edge may be acoustically communicatively coupled to the second side of the diaphragm, wherein sound is caused to be communicated from the second sound inlet port to the second side of the diaphragm via the acoustic resistive element and from the first edge of the acoustic resistive element to the second edge of the acoustic resistive element.

Alternatively, an ECM may include a housing for the microphone. The housing may have a first sound inlet port and a second sound inlet port separate from and spaced apart from the first sound inlet port. A diaphragm may be disposed within the housing with the diaphragm having a first side and a second side. The first side of the diaphragm may be acoustically coupled to the first sound inlet port and the second side of the diaphragm may be coupled to the second sound inlet port. An acoustic resistive element may be disposed within the housing and between the second sound inlet port and a chamber adjacent the second side of the diaphragm. The acoustic resistive element may be formed to include a flange portion having outer edge and an inner edge. The outer edge may be acoustically communicatively coupled to the second sound inlet and the inner edge may be acoustically communicatively couple to the chamber to form a resistance-capacitance network.

Still further, an ECM may include a housing for the microphone with the housing having a sound inlet port. A diaphragm may be disposed within the housing, and the diaphragm may be acoustically coupled to the sound inlet port. An acoustic resistive element may be disposed within the housing and between the sound inlet port and the diaphragm. A backplate may be coupled to the diaphragm for converting motion of the diaphragm into an electrical signal. An amplifier may also be provided to provide an output from the ECM, and the acoustic resistive material may electrically couple the backplate and the amplifier.

For the embodiments of an ECM described herein, the acoustic resistive material may be woven metal, sintered metal, felted metal, woven plastic, sintered plastic, felted plastic, woven organic fiber, sintered organic fiber or felted organic fiber.

Referring to FIG. 1, a unidirectional electret condenser microphone (ECM) 100 may include a housing 101 including a cup-shaped housing section 104, and a bottom housing section 120. The cup-shaped housing section 104 and the bottom housing section 120 may be joined together by crimping, welding or adhesive bonding, for instance. The housing 101 may be made of a conductive material, or to have a conductive material coating thereon. In the embodiment shown, the housing 101 is made of aluminum. A through hole or sound port 106 is formed on a surface 105 of the cup-shaped housing section 104 as shown in FIG. 1 to allow sound to enter a chamber 109. A dust guard 102 which is typically made of cloth or felt is adhered to the cup-shaped housing section 104 with an adhesive to cover the through hole 106 for preventing debris from entering the microphone 100.

The microphone 100 further includes a ring assembly 108 disposed on a base surface 107 of the cup-shaped housing portion 104. The ring assembly 108 includes a vibratory diaphragm 108*a* connected to a ring member 108*b* or diaphragm support. The ring member 108*b* may be made of stainless steel; however, any conductive material or material including a conductive coating, including brass or tin may be utilized. The vibratory diaphragm 108*a* of the ring assembly 108 must be capable of vibrating in response to sound waves. As such, the vibratory diaphragm 108*a* may be made of a thin polymer film. For example, the diaphragm may be a 6 gauge thick polyethylene terephthalate film, commonly available under the trademark MYLAR, or of any similar material. The vibratory diaphragm 108*a* is adhered to the ring member 108*b* of the ring assembly 108. The microphone 100 still further includes a spacer 110 disposed between the ring assembly 108 and a backplate 112 for separating the ring assembly 108 from the backplate 112. The thickness of the spacer 110 sets the spacing between the ring assembly 108 and the backplate 112. The backplate 112 may be formed to include a plurality of sound holes 114 to allow the sound vibrations that enter the housing 101 to vibrate the diaphragm 108*a*. The backplate 112 may be made of stainless steel. The backplate 112 may further have a first surface that is plated with a polarized dielectric film or electret material. For example Teflon material may be coated or plated on the first surface of the backplate 112. The coated backplate 112 is referred to as the fixed electrode of the electret assembly. Additionally, the coated backplate 112 is electrostatically charged.

The spacer 110 is disposed between the ring assembly 108 and the wall of the housing 101 to electrically isolate the vibratory diaphragm 108*a* from the housing 101. The spacer 110 is generally made of a non-conductive material, and for example may be made of a 200 gauge Mylar plastic. As shown in FIG. 1, the spacer 110 provides for spacing the backplate 112 a set distance from the ring assembly 108. This distance provides a defined gap between the backplate 112 and the vibratory diaphragm 108*a*, enabling air movement between the diaphragm 108*a* and the backplate 112.

The dielectric film or electret material on the backplate 112 cooperates with the vibratory diaphragm 108*a* to develop an electric signal representative of the acoustic energy incident on the diaphragm 108*a*. As is understood by one of ordinary skill in the art, the operation of the microphone 100 is based on the change in capacitance between a fixed electrode, the backplate 112, and a movable electrode, the vibratory diaphragm 108*a*, under the influence of external air (sound) vibrations. The change in this capacitance is proportional to the changes in air pressure and can be converted into amplified sound vibrations via the electronic amplifier 122. The amplifier 122 then converts and amplifies the changes in capacitance into an electrical signal representative of those changes.

Figure 2:
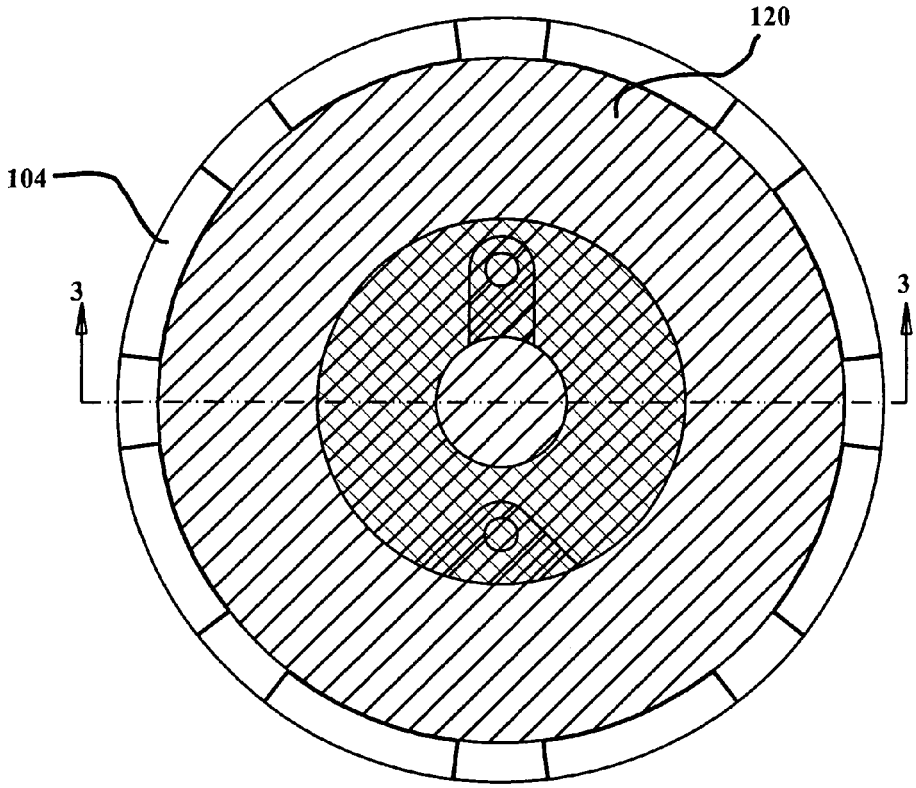
FIG. 2 is a bottom view of the ECM shown in FIG. 1.
Figure 3:
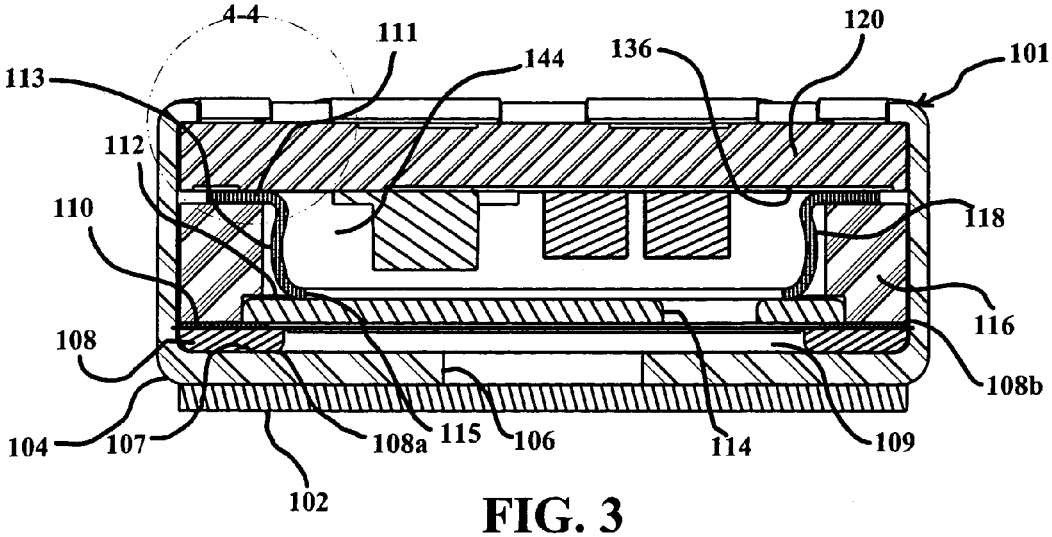
FIG. 3 is a cross-sectional view taken along line 3—3 of FIG. 2.
Figure 4:
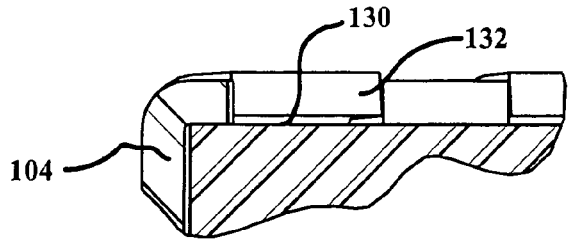
FIG. 4 is a partial cross-sectional view taken within the circle 4—4 of FIG. 3.

The microphone 100 may also include additional sound inlet ports 130 shown in FIGS. 2–4. The sound inlet ports 130, formed on the back of the microphone 100, for example by not completely crimping a flange 132 on the cup-shaped housing portion 104 at selected areas around the circumference of the flange 132, are acoustically coupled to a second chamber 144 adjacent the diaphragm 108*a*. To affect additive combining of sound energy received at the front of the microphone 100 and to cancel sound energy received at the back of the microphone, an acoustic resistive element 118 is provided. The acoustic resistive element 118 may be woven metal, sintered metal, felted metal, woven plastic, sintered plastic, felted plastic, woven organic fiber, sintered organic fiber, felted organic fiber. In the embodiment shown, the acoustic resistive material is conductive wire cloth, such as stainless steel cloth. As such, the acoustic resistive element 118 may also function to electrically interconnect the backplate 112 and electronic amplifier 122, which is placed across the top surface 136 of the bottom housing 120 of the housing 101.

Figure 6:
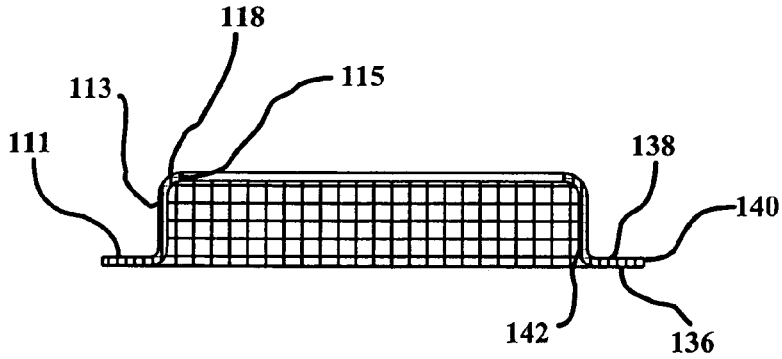
FIG. 6 is a cross-section view taken along line 6—6 of FIG. 5.
Figure 5:
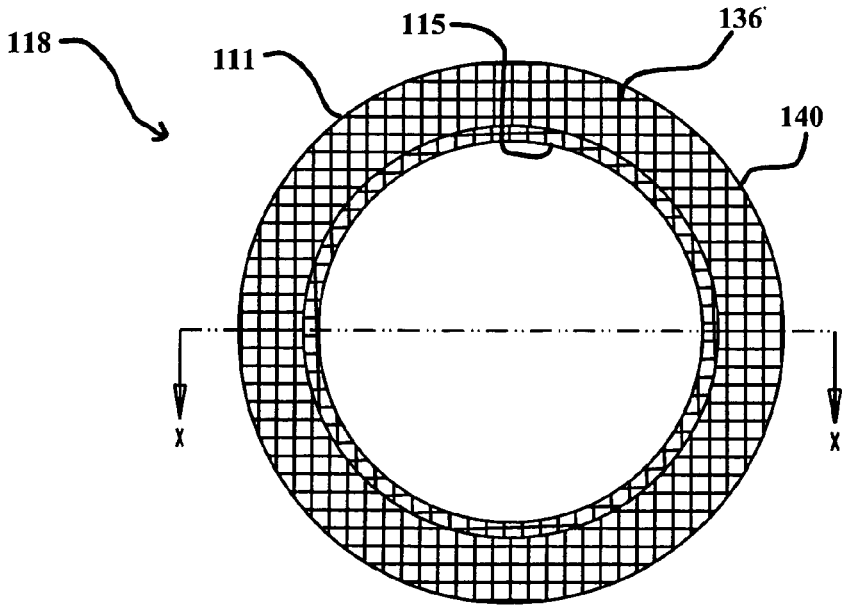
FIG. 5 is a top view of a metal wire cloth that may be used in an ECM.

That is, with continued reference to FIG. 3 and reference to FIGS. 5 and 6, the acoustic resistive element 118 is disposed between the electronic amplifier 122 and the backplate 112. The acoustic resistive element 118 is formed with a top hat-like shape, with a flange or disk portion 111 and a wall or cylinder portion 113 with a lip 115. Flange portion 111 electrically couples to the amplifier circuit board 112, while the lip 115 conductively engages the backplate 112 thereby electrically connecting the backplate 112 to the components on amplifier circuit board 122. The backplate 112 is in electrical connection with ground through the conductive portions of the support member 116 and the housing 101. As mentioned, the acoustic resistive element 118 may made of a conductive metal cloth such as stainless steel; however any conductive material or material having a conductive coating may be utilized in the embodiments of the ECM wherein the acoustic resistive material 118 further serves to provide electrical coupling of the backplate 112 and the amplifier 122.

The acoustic resistive element also acts to delay sound entering from the bottom housing section 120 through sound inlet ports 130. This sound passes around the amplifier circuit board 122 and enters a second chamber 144 via the acoustic resistive element 118. More particularly, the flange portion 111 of the acoustic resistive element has a first surface 136, second surface 138, a first edge 140 and a second edge 142. A sound path is created within the housing 101 such that the sound is caused to enter the acoustic resistive element 118 at the first edge 140, to travel through flange portion 111 substantially parallel to the surfaces 136 and 138, to exit the acoustic resistive material via the second edge 142 and to enter the second chamber 144. This is entirely different than typical configurations wherein the sound is caused to pass through the acoustic resistive elements substantially perpendicular to the surfaces 136 and

138. Alternatively, one will appreciate that the sound may be caused to travel axially within a wall of a cylinder of acoustic resistive material from a first end edge to a second end edge, or in other similar configurations wherein sound is directed to travel within a surface of acoustic resistive material as opposed to normal to the surface. This arrangement has a number of advantages.

The chamber 144 may be configured as a relatively large acoustic volume that acts as the capacitance, "C", of the resitance-capacitance, "RC", network. By increasing the capacitance value, the resistance may be made smaller, and hence easier to control. A consistent value of R may be obtained by using wire cloth, as described, and by arranging the acoustic path such that the sound travels from the edge 140 to the edge 142. The acoustic resistive element 118 enables setting of the directivity of the microphone 100 as is well known in the art by tuning the RC value of the RC network formed by the acoustic resistive element 118 and the second chamber 144.

Thus, in accoradance with the embodiments shown and described, sound enters an ECM at a first sound inlet port and enters a first chamber adjacent a first side of a diaphragm. Sound also enters the ECM at a second sound inlet port passes through an acoustics resistive material by traveling within a surface of the material from a first edge to a second edge of the material and enters a second chamber adjacent a second side of the diaphragm. The acoustic resistive material and the second chamber form an RC network such that the sound entering the first chamber is reinforced while the sound entering the second chamber is canceled.

All references, including publications, patent applications, and patents, cited herein are hereby incorporated by reference to the same extend as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. It should be understood that the illustrated embodiments are exemplary only, and should not be taken as limiting the scope of the invention.

What is claimed is:

1. A microphone comprising:

a housing for the microphone, the housing having a sound inlet port;

a diaphragm disposed within the housing, the diaphragm acoustically coupled to the sound inlet port;

an acoustic resistive element disposed within the housing and between the sound inlet port and the diaphragm;

a backplate coupled to the diaphragm for converting motion of the diaphragm into an electrical signal; and an amplifier; wherein the acoustic resistive material electrically couples the backplate and the amplifier.

2. The microphone of claim 1, wherein the acoustic resistive material comprises at least one of: woven metal, sintered metal, felted metal, woven conductive plastic, sintered conductive plastic, felted conductive plastic, woven conductive organic fiber, sintered conductive organic fiber, felted conductive organic fiber.

3. The microphone of claim 1, wherein the acoustic resistive element is formed from a volume of acoustic resistive material having an outer surface and an inner surface, the inner surface substantially contained within the volume, the outer surface being acoustically communicatively coupled to the sound inlet and the inner surface being acoustically communicatively couple to the diaphragm.

* * * * *

UNITED STATES PATENT AND TRADEMARK OFFICE

CERTIFICATE OF CORRECTION

PATENT NO. : 7,136,500 B2
APPLICATION NO. : 10/634552
DATED : November 14, 2006
INVENTOR(S) : James S. Collins It is certified that error appears in the above-identified patent and that said Letters Patent is hereby corrected as shown below:

On the Title Page:

Item (73), "LLC." should be -- LLC --.

In the Claims:

Column 6, line 42, "couple" should be -- coupled --.

Signed and Sealed this

Seventeenth Day of April, 2007

JON W. DUDAS
*Director of the United States Patent and Trademark Office*